United States Patent [19]

Wood

[11] 4,170,090

[45] Oct. 9, 1979

[54] WEATHER STRIP AND BALANCE ASSEMBLIES FOR WINDOWS

[75] Inventor: Edward H. Wood, Sanford, N.C.

[73] Assignee: Jim Walter Corporation, Tampa, Fla.

[21] Appl. No.: 917,926

[22] Filed: Jun. 22, 1978

[51] Int. Cl.[2] ..... E05D 15/22

[52] U.S. Cl. ..... 49/176; 49/181; 49/430

[58] Field of Search ..... 49/181, 161, 430, 446, 49/176

[56] References Cited

U.S. PATENT DOCUMENTS

| | | | |
|---|---|---|---|
| 2,907,079 | 10/1959 | Lundgren | 49/430 |
| 3,046,618 | 7/1962 | Teggelaar | 49/430 |
| 3,122,798 | 3/1964 | Zegers et al. | 49/430 |
| 3,197,819 | 8/1965 | Trout | 49/181 X |
| 3,676,956 | 7/1972 | Taylor et al. | 49/181 X |

*Primary Examiner*—Philip C. Kannan

*Attorney, Agent, or Firm*—Schroeder, Siegfried, Ryan, Vidas & Steffey

[57] ABSTRACT

This invention relates to a weather strip and balance assembly for a window of a tilt sash type. The assembly includes a mounting plate for mounting the balance assembly thereon with a weather strip being clipped thereto and supporting the sash in a sliding and sealing manner. The weather strip has a pair of curved supporting ridges which mount the sash at conventional grooved surfaces along the stiles of the same and a recessed divider portion between the curved ridges in the weather strip provides for mounting and movement of the coupling pins which connect the balance assemblies to the sash and permit tilt of the sash on the weather strip. The mounting members on the sash for coupling the pins thereto provide mating keyed surfaces such that the pins rotate with the sash. These mounting members also include guide surfaces which couple the sash in a closed position and include the provision of a sweep lock member to secure the sash in a closed position. An alternate embodiment of the invention discloses a locking assembly in the form of a locking cord cooperating with the mounting pins to lock the balance assemblies upon tilt of the sash.

19 Claims, 6 Drawing Figures

WEATHER STRIP AND BALANCE ASSEMBLIES FOR WINDOWS

FIELD OF INVENTION

This invention relates to a weather strip and balance assembly for a window having a tilt-type sash, and more particularly to a unitary weather strip and balance assembly which permits tilting of sash on a weather strip while maintaining a positive seal between a sash and a weather strip for the normal sliding position of the sash.

In the past, the weather strip and balance assemblies incorporated in both tilt and non-tilt type windows have been separate components which are combined upon installation of the same into a window with the sash. Where balance assemblies have been combined with a weather strip as a jamb liner, the components have been separately manufactured and combined at the point of usage through specialized fastening devices to secure the same to a window frame. The use of individual components or separate structures combined at the point of installation have increased the expense of manufacture, storage and handling and the cost of installation of the same. More importantly, such structures have less flexbility in the mounting of a sash, particularly for tilt type windows, diminishing the effectiveness of the seal between the weather strip and the sash. In the case of tilt-type windows, flexibility of the weather strip is necessary to permit tilt of the sash and any loss of such flexibility diminishes the effectiveness of the weather strip seal. Examples of weather strip and balance assemblies which are manufactured as separate units and combined with fasteners at the point of installation will be found in the patents to C. G. Teggelaar U.S. Pat. Nos. 3,046,618 and W. H. Zegers et al 3,122,798.

SUMMARY OF INVENTION

The present invention is directed to an improved weather strip and balance assembly which is manufactured as a composite unit, thereby eliminating any assembly of parts at the point of usage. The improved weather strip and balance assembly requires only installation in the window frame and connection to a sash to be operative. The weather strip and balance assembly is manufactured, shipped and installed as a single unit on a jamb liner to mount a sash within the window frame. The weather strip may be formed of a semi-rigid polyvinyl or a flexible metal material, and it incorporates a retainer or mounting plate to give the weather strip bowed configuration across its width. The assembly is sized to fit within a side jamb of a window frame, and the weather strip is formed with a pair of spaced ridges on its bowed surface with a recessed center portion therebetween. The ridges and recessed center portion extend the length of the weather strip. The ridges are adapted to mount a pair of sash and the weather strip with the mounting plate behind the same will permit deformation or compression to allow the sash to be tilted in the weather strip. The sash incorporates conventional grooves on stiles of the same to slidably mount on the ridges of the weather strip. Each of the ridges between the mounting plate and the under or back surface of the weather strip house a spring, sash cord, and pulley blocks of the balance assembly. The springs are secured to the mounting plate through a mounting flange to hold the springs in position within the weather strip near one end of the weather strip. At the opposite end of the mounting plate, a pulley block assembly is mounted which includes pulleys associated with each balance assembly to direct the sash cord to the center recessed portion on the front of the weather strip. The springs have additional pulleys attached thereto and one end of each of the sash cords is secured to the pulley block assembly, as will be hereinafter noted, with the sash cords being directed around the pulleys and out to the center recessed portion of the weather strip on the face thereof. The sash cords extend down the center recessed portion of the face of the weather strip and have pin members attached to the free end of the same which secure the sash cords to the sash and guide and retain the sash within the weather strip as the sash are tilted. Frictional forces between the stiles of the sash and the face of the weather strip when the sash is tilted hold the sash in the tilted position.

The improved weather strip and balance assembly is particularly adapted for use with tilt type sash in that the weather strip compresses to permit tilt of the sash and returns to its normal shape when the sash is positioned on the ridges to insure a positive seal therebetween. Suitable retainer members are mounted on the sash to hold the pins in the center recessed portion of the weather strip when the sash are installed thereon. Additional guide and lock members, which are tongue and groove in form, connect the upper and lower edges of the bottom and top sash respectively to positively hold the sash in the closed position and insure alignment of the sash on the weather strip. They also serve to mount a sweep lock member to secure the sash in a fixed position.

The improved weather strip and balance assembly will be best understood from a review of the attached drawings wherein:

IN THE DRAWINGS

DESCRIPTION OF THE PREFERRED EMBODIMENT

Figure 1:
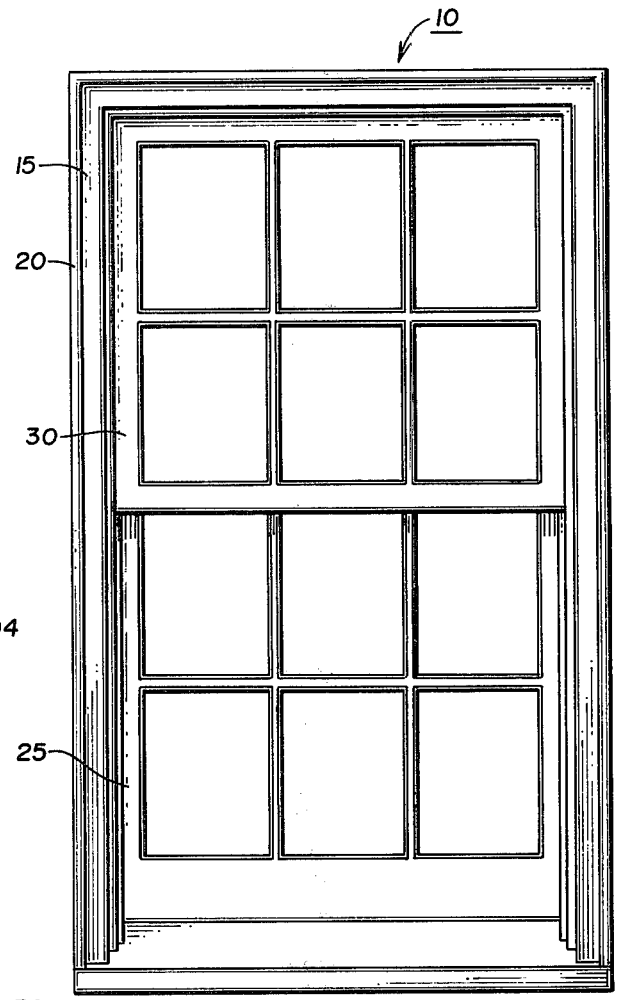
FIG. 1 is an elevation view of a double hung window frame incorporating the improved weather strip and balance assembly.

My improved weather strip and balance assembly for a tilt type window is shown in FIG. 1 as applied to a double hung window indicated generally at 10. The window is comprised of a frame 15 having suitable trim, indicated generally at 20, mounted thereon, and the frame mounts a pair of sash 25, 30 which are slidably positioned in the frame on the side jambs thereof.

Figure 2A:
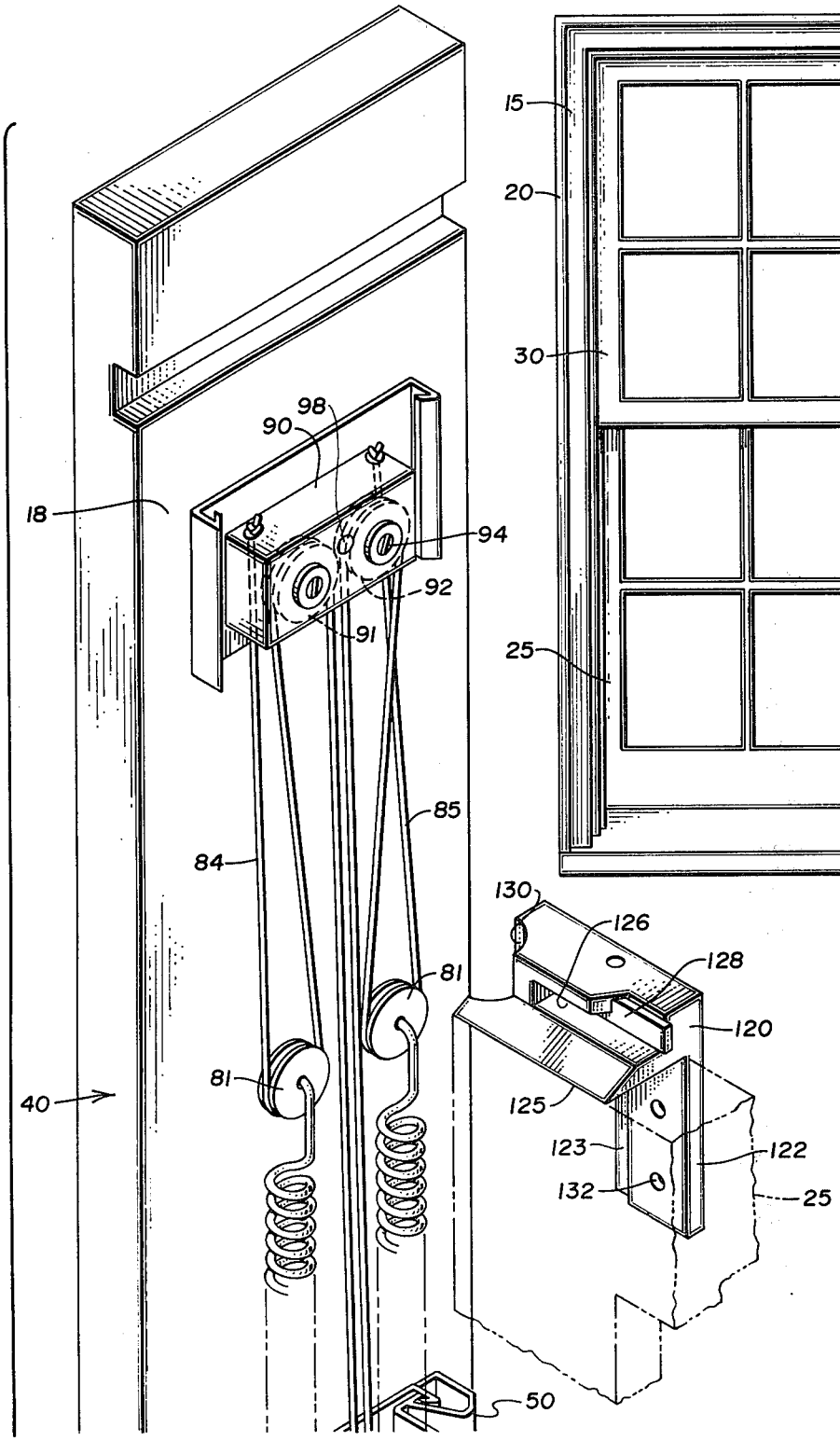
FIG. 2 is a perspective view of a portion of the frame, shown in two parts, Figures a and b. They show one side of the weather strip and balance assembly with portions of the sash spaced therefrom and with parts broken away.
Figure 2B:
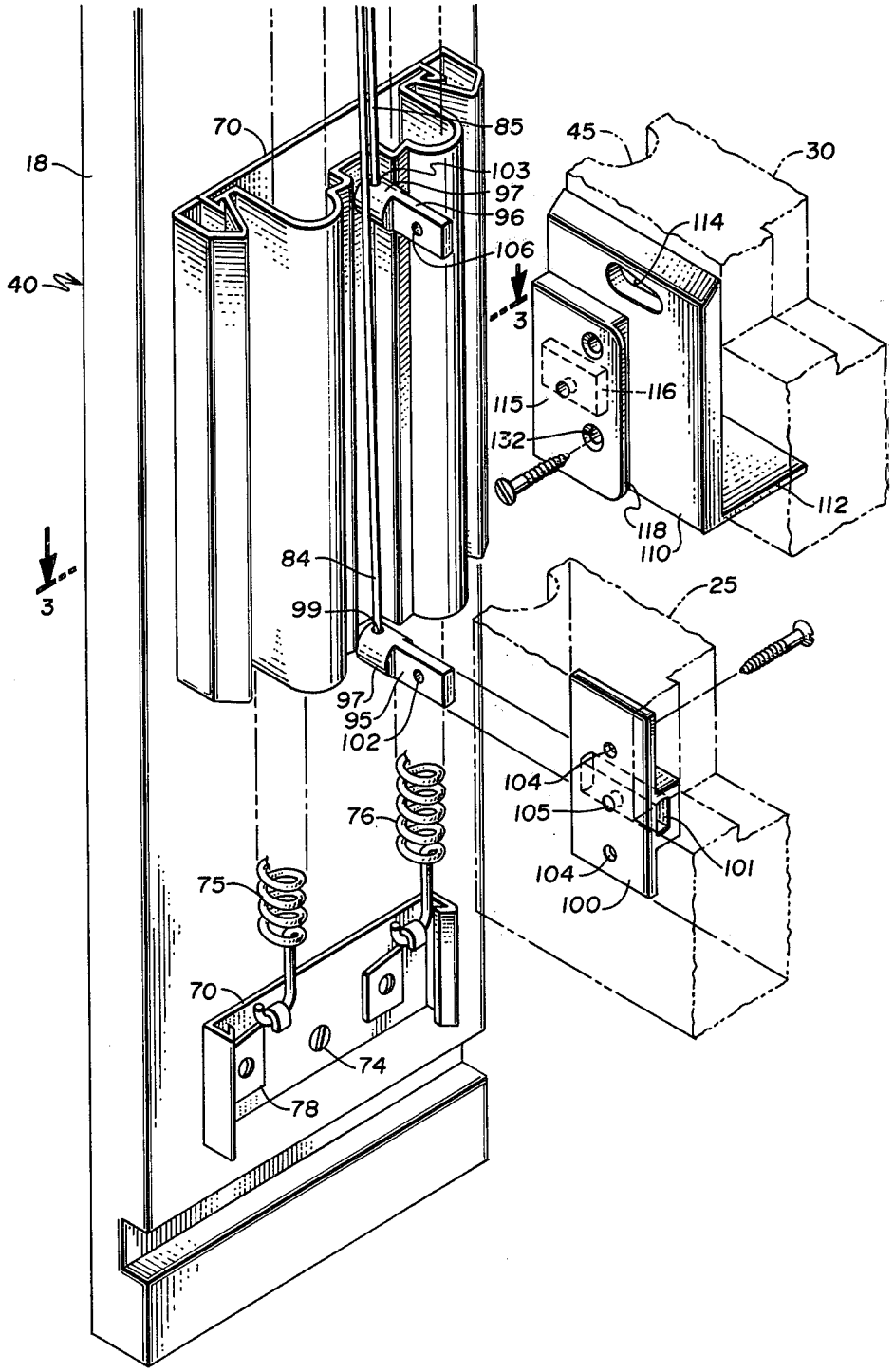
Figure 4:
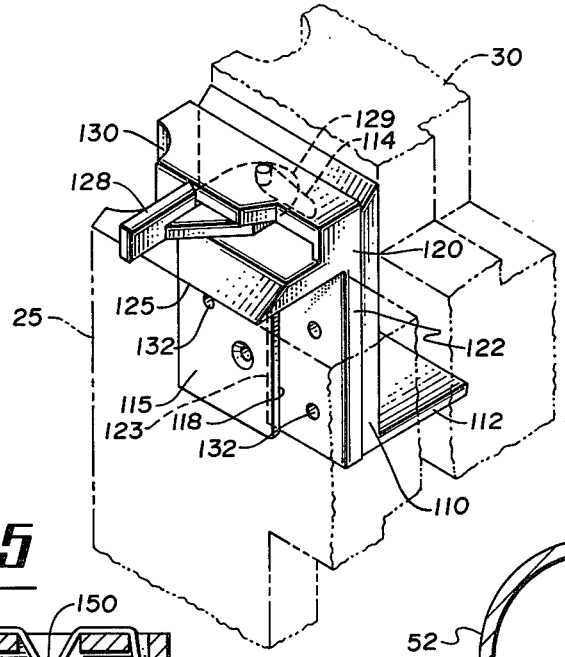
FIG. 4 is a perspective view of the guide and lock assembly incorporated with the improved weather strip and balance assembly; and, FIG. 5 is a schematic view of an alternate embodiment of the weather strip and balance assembly incorporating a tilt lock.

As will be best seen in FIG. 2, the frame 15 has jambs 18 on which are positioned jamb liners 40 for purposes of mounting the sash thereon. The jamb liners have curved surfaces, as will be hereinafter noted, and the sash have corresponding grooves 45 in the stiles of the same to ride on the curved surfaces of the jamb liners 40. The sash are adapted to tilt out from the jamb liners for purposes of cleaning in a conventional manner.

In the preferred embodiment of FIGS. 1 through 4, the jamb liners mount a balance system whch does not include a locking structure to lock the balance system when the sash are tilted on the jamb liners. Frictional forces are relied on in this embodiment to hold the sash in position upon tilt.

The jamb liners 40 combine a weather strip member 50 and balance assemblies as will be hereinafter noted. The weather strip 50 is preferably made of a polyvinyl or flexible metal material and may be extruded or otherwise formed as an elongated member which extends substantially the length and width of the window jamb. As will be best seen in FIG. 3, the weather strip has a pair of curved ridge members 52, 53 separated by a recessed center portion 54. The curved ridges 52, 53 mount the sash in the window frame and slidably support the same thereon. To either side of the ridges are recessed surfaces 54 which contribute to the flexibility of the weather strip and provide compressive as well as translational movement of the ridges in support of the sash to effect a seal therebetween. The ends of the weather strip are turned in as at 55. As will be best seen in FIG. 3, the undersurface of the weather strip adjacent the recessed portions 54 have translationally extending retaining tabs 56 formed integral thereon.

In addition to the weather strip member 50, the jamb liner includes a mounting plate 70 having a length dimension equal to the length of the weather strip member and a width dimension such as to fit between the ends 55 of the weather strip member. The mounting plate 70 is preferably made of a plastic or flexible metal material and it includes upstanding flanges 71 bent transverse the extent of the main body of the mounting plate with inclined flanges 72 at the ends of the same. As will be best seen in FIGS. 2, and 3, the flanges 72 fit around the tabs 56 on the undersurface of the weather strip to retain the weather strip on the mounting flange. As will be hereinafter noted, the mounting flange is adapted to be positioned against the jamb of the window frame and secured thereto with the weather strip being snapped over the same and retained thereon. The weather strip member is flexible and generally bowed along its width such as to mount the sash in the window frame with the sash riding on the raised rib portions 52, 53 which fit in the grooves 45 in the stiles of the sash. The weather strip member may be compressed inwardly in the mounting of the sash in the window frame and the recesses 54 allow for translational movement to insure a proper fit of the sash on the curved ribbed portions 52, 53, and a positive seal therebetween. The recessed center portion 54 is generally rectangular in cross section, and as will be hereinafter noted, will mount or slidably position pins secured to the sash for retaining the sash on the weather strip.

Figure 3:
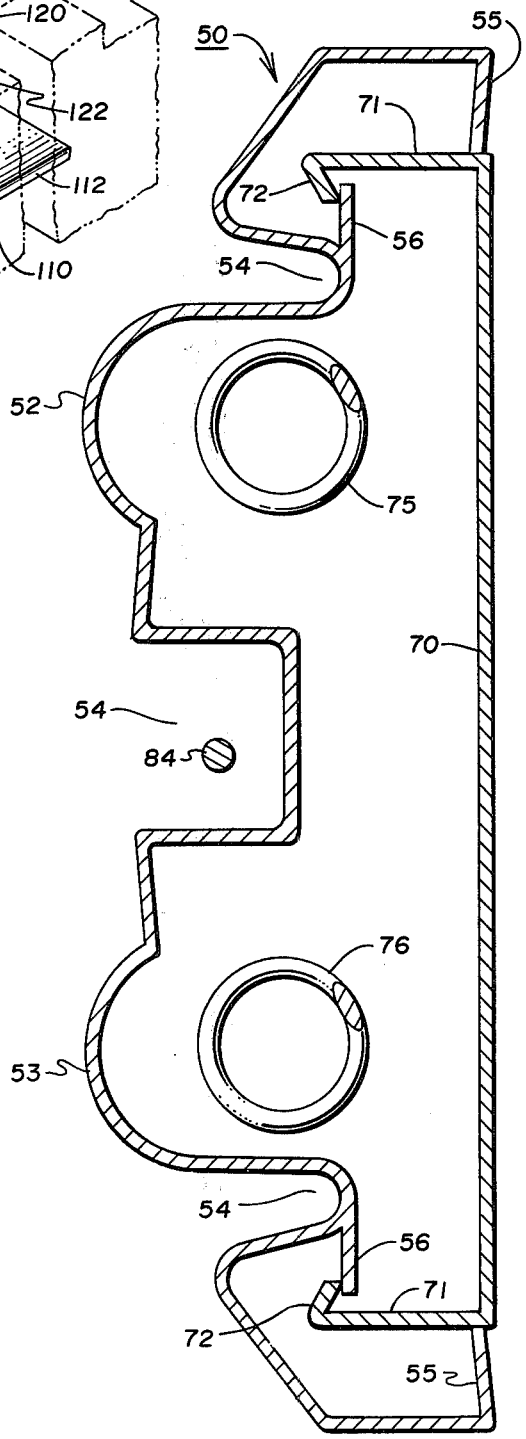
FIG. 3 is a sectional view of the weather strip and balance assembly of FIG. 2*b* taken along the lines 3—3 therein.

The mounting plate 70 mounts the balance system for each sash and these balance systems are located between the mounting plate and the undersurface of the weather strip as will be best seen in FIGS. 2 and 3. Each balance system is comprised of an elongated helical spring 75, 76, which are secured at one end respectively to brackets 78 riveted on the lower end of the mounting plate. The opposite end of each spring mounts a pulley member 80 81 which couple sash cords to the springs. Each of the balance assemblies in the jamb liner include a separate sash cord indicated at 84, 85 respectively, which are secured at one end to a pulley mounting block 90 carried by the upper end of the mounting plate 70. The sash cord is directed over the pulleys 81, 82 on the ends of the springs 75, 76 and baked over pulleys indicated at 91, 92 respectively in the pulley mounting block with the free end of the respective sash cords being directed down the extent of the recessed center portion 54 on the outer surface of the weather strip. Suitable pin members 95, 96 respectively, are secured to the ends of the respective sash cords 84, 85 and are coupled to the sash, as will be hereinafter noted. The springs 75, 76, as well as the sash cords and pulley attached thereto, are located within the jamb liner behind the curved ridge portions 52 53 such that the jamb liner may be compressed or removed for installation of the sash or upon tilt of the sash, will present no interference with the balance system components. One end of the mounting plate 70 in the area of the bracket members 78 securing one end of the springs to the mounting plate includes an aperture through which a screw 74 may be inserted to secure the mounting plate to a side jamb of a window frame. Similarly, the pulley mounting block 90 is a plural part structure with the pulley members 91, 92 journaled therein and with apertures extending through the axles of the pulleys so that screw means 94 may be positioned therethrough to mount the upper end or opposite end of the mounting plate to the jamb of the window frame. The ends of the sash cords 84, 85 are tied or otherwise secured to the mounting block and a portion of the weather strip adjacent the mounting block has the recessed center portion cut away to permit exit of the sash cords to the face side of the weather strip such that the sash cords may be directed down the weather strip to the pin members 95, 96 which are slidably positioned in the recessed center portion 54. Pulley block 90 is secured to the upper end of the mounting plate through a suitable rivet indicated at 98 which extends through the pulley block and secures the same to the upper end of the mounting plate in manufacture. Thus, in manufacture, the balance assemblies are mounted on and secured to the mounting plate as a composite unit with the weather strip snapped on to the mounting plate to complete the jamb liner. Upon installation, the jamb liner is secured through the mounting plate by the screws 74 and 94 to the jamb to install the same on a window frame. The mounting plate becomes load bearing upon installation and during manufacture, storage and shipment there is no load applied to the same through the balance system, such as to cause warpage or bending.

The balance systems are connected to the respective sash through mounting blocks members which secure the ends of the pins 95, 96 to the sash. As will be seen in FIGS. 2, and 4, the lower sash 25 has a mounting member 100 positioned on the lower inside edge of the sash adjacent each of the jamb liners which mounting member has a generally rectangular or keyed recess 101 extending therethrough. The pin 95 has a head portion 97 which is generally cylindrical and through which an aperture 99 extends with the remainder of the pin having a cross-sectional dimension symmetrical with the aperture 101 in the mounting block such that this end of the pin will fit therethrough. Suitable mounting holes 104 are positioned in the block such that the same may be secured to the inner surface of the sash of the edges of the same. An additional aperture 105 is positioned therein and this aperture is adapted to receive a screw which extends through an aperture 102 in the pin 95 to secure the pin rigidly to the sash. The same construction is present on each of the mounting blocks 100 on each lower and inner face of the lower sash. Block 100 has inclined edges and a thickness dimension that is generally equal to the spacing between the sash as they are mounted on the respective curved surfaces 52, 53 of the jamb liner. Thus, the surface of the upper sash will slide and bear against the block 100 as the upper sash is drawn down on the jamb liners. The upper sash 30 adjacent its lower outer surface or that facing the inner sash has a generally square block member 110 mounted at the lower edge of the same, the block member having a translationally extending flange portion 112 at the base of the same which fits the block member around the lower edge of the upper sash. Block member 110 is part of a sweep lock mechanism and a suitable aperture 114 in the face of the same is adapted to receive a sweep lock as will be hereinafter noted. Member 110 also includes a mounting portion 115 formed integral therewith and projecting along the surface of the same which portion has a recessed aperture 116 therein. The aperture 116 has a cross-section similar to a keyed portion of pin 96 which is similar to the surface of pin 95. Pin 96 also includes a head portion 97 adapted to ride in the recessed center portion 54 of the weather strip with an aperture 103 therein through which a sash cord extends. The pin 96 also has an aperture 106 therein which is adapted to receive a mounting screw to secure the pin in the mounting portion 115 of block 110. The mounting block 110 also serves as a portion of a sash guide structure and has a projecting flange or tongue 118 on the edge of the same which cooperates with a similar grooved part in a sash guide and sweep lock member, indicated generally at 120, and mounted on the upper edge of the inner sash 25 on the inner surface thereof. As will be seen in FIGS. 2 and 4, the guide and lock member 120 has a downwardly extending guide flange portion 122 with a groove 123 therein designed to receive the tongue or flange portion 118 of the member 110. A transversely extending flange portion 125 fits across the top of the inner sash and the upper end of the guide and lock member has a recessed area 126 in which is positioned a pivoted sweep lock 128 having a camming head 129 on the end of the same designed to fit into the groove 114 in the member 110. The sash and guide member 120 is also grooved as at 130 at the surface adjacent the curved portion of the sash such that the groove corresponds with the grooved recess in the sash and mates with the ribbed surface 52 of the weather strip member. The flange 112 has a similar grooved surface (not shown) on the edge adjacent the edge of the sash and corresponding with the groove 45 in the sash such that it will ride on the ridge 53 of the weather strip. Both the members 210 and the guide and lock member 120 have suitable mounting holes, indicated at 132, therein through which screws are adapted to extend to mount the respective members on the sash.

The mounting member 110 and the sash and guide member 120 when positioned on the respective sash mate such that the guide portions 122 and the mounting portion of 115 and the respective parts slide adjacent one another with the tongue or flange 118 riding in the groove 123 in the cooperating part to hold the respective sash in spaced relationship. The thickness of the member 110 at the mounting portion is basically the same thickness as the mounting member 100 on the lower face of the lower sash and serves as a guide to hold the sash separated or spaced on the respective ribbed mounting portions 52, 53 of the weather strip.

In the installation of the jamb liners on the window frame, the weather strip member 50 may be removed from the mounting member 70 by translationally squeezing the ribbed portions 52, 53 together to release the flanges 56 from the flange portion 72 of the mounting member. The mounting member may then be positioned on the jamb surface of the window frame and the screws 94 and 74 installed to secure the mounting member to the jamb surface of the window frame. Thereafter, the weather strip may be snapped into position over the mounting member with the sash cords 84, 85 brought out through the recess at the upper end of the same such that the sash cords with the pins 95, 96 on the ends of the same are located in the recessed center portion 94 of the weather strip. The mounting members 100, 110 and sash and guide members 120 are then installed on the surface of the respective sash adjacent the sides of the same. With the member 100 installed on each side of the lower sash, the pins 95 may be inserted into the keyed aperture 101 of the mounting members and suitable screw means directed into the sash to secure the same therein. The weather strip will be displaced inwardly to bring the grooved sides of the stiles into position over the ribbed surface of the weather strip. The upper sash is similarly installed in the same manner with the pins 96 being directed through the apertures 116 in the mounting portions 115 of the members 110 on the outer surface of the upper sash and on the lower edges of the same. The weather strip may be similarly compressed to permit the positioning of the pins 96 in the recessed center portion as the sash is mounted on the ribbed surface 53 of the weather strip. Adjustment of spring tension for the respective sash will be effected prior to installation of the pins by applying tension to the springs through the sash cords and securing the pins on the ends of the sash cord at the respective points which will apply sufficient pressure at the raised and lowered position of the respective sashes. When the sash are installed on the jamb liners, they may be pivoted away from the weather strip with the head portions 97 of the respective pins holding the pins in position on the jamb liner. The compressive and translational movement of the respective weather strip members permit displacement of the sash such that it may be tilted out for cleaning or maintenance purposes and returned to an aligned position for the weather strip and riding on the curved surface for the weather strip for sealing and guiding purposes.

The improved weather strip and balance assembly does not include any provision for locking the balance assembly for tilt of the window in this embodiment. Thus, it is possible that the window may move in a tilted position. However, normal frictional forces between the sash and the weather strip generally restrict such movement when the window is in a tilted position.

The improved weather strip and balance assembly provides an arrangement in whch the balance assembly is factory mounted and installed in the jamb liner so that it merely need be secured to the jamb and connected to the sash upon installation. The flexible ribbed surfaces 52, 53 of the weather strip bear against the grooved surfaces of the sash in all sliding positions to insure positive and dynamic seal under all conditions. The weather strip member permits translational movement of the ribbed surfaces in the installation and for alignment purposes. The mounting and sash guide members 110, 120 cooperate to lock the sash in a closed position on the weather strip to prevent tilt of the same and to permit operation of the sweep lock which will prevent separation of the sash. The improved system is relatively economical and easy to install.

Figure 5:
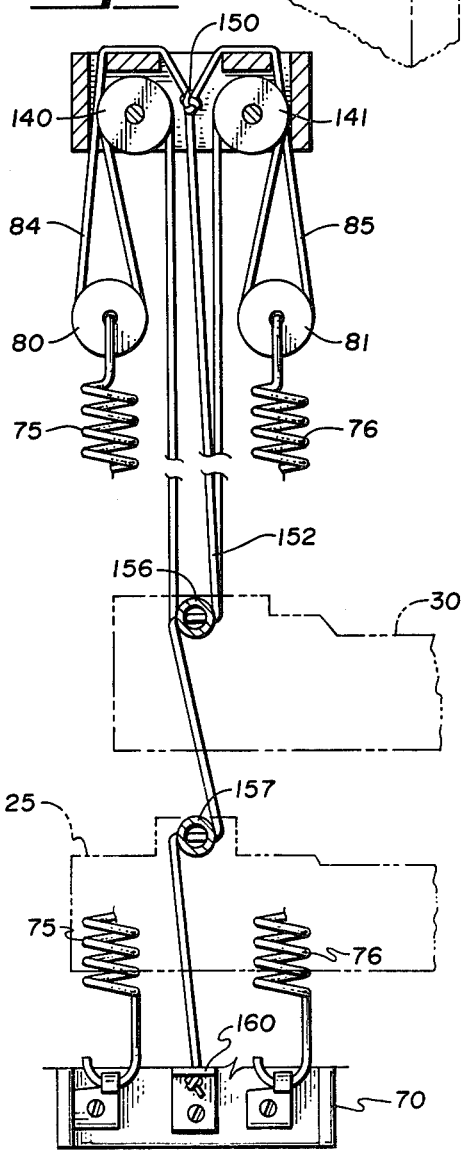

FIG. 5 shows an alternate embodiment of the structure of FIGS. 1 through 4 in that it includes a locking provision for the balance assembly upon tilt of the sash. Since the backing plate and weather strip member together with the mounting of the balance assembly therein, is unchanged from the preferred embodiment, its details will be omitted for simplicity. Simiarly, the mounting and guide members 100, 110 and 120 are identical with this embodiment in serving to guide the sash, mount the pins to secure the balance assemblies for the same and to include the provisions for the sweep lock to lock the sash in a closed position. In this embodiment, the springs 75, 76 are secured to the mounting plate on the respective flanges and the sash cords 84, 85 are directed over double grooved pulleys indicated at 140, 141 with the ends of the sash cords normally tied to the pulley mounting block 90 being connected together as at 150. The sash cords are directed above the pulleys 80, 81 mounted on the ends of the springs 75, 76 with the free ends being directed back over the pulleys to the common juncture point 150. At this point a locking cord 152 is connected to the coupling 150 and it extends down the recessed divider portion 54 through additional apertures 156, 157 in the pins 95, 96. The securing ends of the sash cords 84, 85 are connected through the apertures 98 (not shown) in the respective pins. The locking cord 152 as directed through the apertures 156, 157 in the pins and is secured at its opposite end to the mounting flange or plate 70 as at 160. In this arrangement of parts, the pins as they are tilted will twist the locking cord 152 around the edges of the same causing the locking cord to bear against the sides of the recess center portion 54 in the weather strip 50 to frictionally grip the pin and hold the sash in position. Whenever the sash are righted or aligned with the weather strip ridges 52, 53 the locking cord 152 will freely slide through the apertures 156, 157 such as to present no interference with movement of the sash. By connecting the anchoring ends of the sash cord over a separate pulley groove, sufficient play is provided with the locking cord 152 so that it may be wound on a head portion of a mounting pin for tilt purposes. The lower end of the locking cord is secured to the mounting plate at one end and the bias force as applied to the sash through the pins from the springs will be nullified and the sash effectively locked in a tilted position.

The weather strip and balance assembly of this embodiment is installed in the same manner in a window frame, and the individual bias or tension applied from each balance assembly is adjusted by altering the point of connection of the respective sash cords with the pins through the apertures 98 therein. There is sufficient clearance between the pins and the bottom of the recessed divider portion 54 in the weather strip so that one sash cord will not present any interference with the other in sliding the sash in the window frame.

In considering this invention, it should be remembered that the disclosure is illustrative only and the scope of the invention should be determined by the appended claims.

What I claim is:

1. A weather strip and balance assembly for a tilt-out sash window having a window frame including jambs and at least one sash having side stiles sliding in the side jambs of the window frame comprising: a jamb liner adapted to be positioned between the side stiles of the sash and the window frame jambs; each jamb liner being a weather strip having a ribbed surface adapted to slidably mount and seal to the side stiles of the sash and with a recessed surface adjacent the same, a mounting plate positioned behind and locked to the weather strip to permit flexing of the weather strip relative to the jambs of the window frame; a balance assembly positioned within each jamb liner, said balance assembly including a balance spring with a sash cord coupled thereto and directed over pulleys to apply tension of the balance spring to the sash, anchor means positioned within each jamb liner at the ends of the same and mounting one end of the spring and one of the pulleys to the jamb liner; and means adapted to be connected to the ends of the sash to connect the sash cord to the sash, said last named means being pins adapted to ride in the recessed surface of the weather strip and guide and retain the sash on the weather strip when it is tilted on the weather strip.

2. The weather strip and balance assembly of claim 1 in which the weather strip of the jamb liner includes a pair of ribbed surfaces with the recessed surface therebetween and in which the sash cord is brought out from one end of the weather strip through an aperture in the recessed surface with sash cord extending down the recessed surface for connection to the sash.

3. The weather strip and balance assembly of claim 2 in which the pair of ribbed surfaces of the jamb liner are adapted to mount a pair of sash with the recessed surface therebetween receiving the sash cords from balance assemblies positioned behind the ribbed surfaces of the weather strip and associated with the respective sash.

4. The weather strip and balance assembly of claim 1 in which the weather strip has an outwardly bowed configuration with the ribbed surfaces being defined by recessed portions in the weather strp on either side of the ribbed surfaces and apart from the recessed surface permitting translational flexing of the ribbed surfaces relative to one another and compression of the weather strip.

5. The weather strip and balance assembly of claim 4 in which the mounting plate is a member fitted into the weather strip and having portions contacting flanges on the inner side of the ribbed surfaces of the weather strip.

6. The weather strip and balance assembly of claim 1 and including anchor means positioned on the ends of the mounting plate to anchor one end of each spring and one of the pulleys at the respective ends of the weather strip.

7. The weather strip and balance assembly of claim 1 and including means adapted to be connected to the sash to mount the pin means thereon.

8. The weather strip and balance assembly of claim 1 in which the pins each have a head portion which projects into the recessed surface of the weather strip and cooperate with a locking means secured to the balance assembly and coupled to the pins to lock the sash cords in the weather strip.

9. The weather strip and balance assembly of claim 8 in which the head portion of each pin has an aperture therein and in which the locking means coupled to the pins is an additional sash cord connected between the ends of the sash cord common to the pulleys and remote from the sash and the springs to form a locking cord which passes through an aperture in the head portion of the pin and locks the sash cord connected to the sash on the head portion of the pin with tilt of the sash.

10. A weather strip and balance assembly for a double hung sash type window having a window frame with a pair of sash therein slidably mounted on the jambs of the window frame, comprising: a weather strip for each side jamb each having a pair of ribbed portions on a generally bowed extent with a recessed divider portion therebetween, a mounting plate fitted into and mounting on the weather strip and bearing against the same to retain the weather strip in the bowed configuration and to allow flexure of the weather strip; said weather strips being adapted to be positioned between the side stiles of the sash and the jambs of the window frame to slidably mount the sash on each side thereof; balance assemblies incorporated into the weather strip with each assembly having a balance spring having a sash cord coupled thereto by a pulley and with another pulley directing the ends of the sash cord out of the weather strip; said balance assemblies being located behind the ribbed portions of each weather strip on the mounting plate, anchor means securing the spring and a pulley for each assembly to opposite ends of the mounting plate; means positioned in the anchor means for securing the anchor means to the jambs of the window frame at the ends of the weather strip; and pin means connected to the sash cord of each assembly for applying tension from the balance to the sash, said pin means being positioned in the recessed divider portion for guiding the sash and retaining it on the weather strip upon tilt of the sash in the window frame.

11. The weather strip and balance assembly of claim 10 in which the mounting plate fitted into the weather strip has portions contacting flanges on the undersurface of the pair of ribbed portions of the weather strip to retain the weather strip thereon.

12. The weather strip and balance assembly of claim 10 and including mounting blocks adapted to be mounted on the sash to retain the pins on the sash aligned with the recessed divider portion when the sash is mounted on the ribbed portions of the weather strip.

13. The weather strip and balance assembly of claim 12 in which each pin has a head portion which closely fits into and slides in the recessed divider portion of the weather strip.

14. The weather strip and balance assembly of claim 13 in which each pin has a key surface remote from the head portion which fits into an aperture in the mounting block having a dimension to fit the key surface such that the pin is rotated with tilt of the sash.

15. The weather strip and balance assembly of claim 14 and including sash guide means adapted to be mounted on each of said sash in said window frame adjacent said weather strip for guiding and holding the sash in a closed position, certain of said mounting blocks forming a part of said sash guide means.

16. The weather strip and balance assembly of claim 13 in which the sash guide means includes tongue and groove cooperating parts.

17. The weather strip and balance assembly of claim 16 and including sash lock means included in said sash guide means, said sash lock means being formed of sweep lock members and retaining flange members mounted respectively on the sash guide means for a pair of sash.

18. The weather strip and balance assembly of claim 14 in which the pins each have head portions projecting into the recessed divider portion of the weather strip and cooperate with locking means secured to the balance assembly to lock the sash cords to the weather strip.

19. The weather strip and balance assembly of claim 18 in which the head portions of each pin have an aperture therein and in which the locking means coupled to the pins is an additional sash cord, said additional sash cord being connected to the sash cords of the first named pulleys at one extremity and to the anchor means remote from the pulleys with the locking cord extending through an aperture of the head portions of the pins, said sash upon tilt being operative to rotate said pins and lock said sash cords connected to the sash.

* * * * *

UNITED STATES PATENT AND TRADEMARK OFFICE

CERTIFICATE OF CORRECTION

PATENT NO. : 4,170,090

DATED : October 9, 1979

INVENTOR(S) : Edward H. Wood

It is certified that error appears in the above-identified patent and that said Letters Patent are hereby corrected as shown below:

Column 1, line 9, after "of" insert --a--.

Column 1, line 49, after "nyl" insert --material--.

Column 1, line 51, before "bowed" insert --a--.

Column 3, line 7, "whch" should be --which--.

Column 4, line 6, "baked" should be --backed--.

Column 5, line 56, "210" should be --110--.

Column 6, line 60, "whch" should be --which--.

Column 7, line 13, "Simiarly" should be --Similarly--.

UNITED STATES PATENT AND TRADEMARK OFFICE

CERTIFICATE OF CORRECTION

PATENT NO. : 4,170,090

DATED : October 9, 1979

INVENTOR(S) : Edward H. Wood

It is certified that error appears in the above-identified patent and that said Letters Patent are hereby corrected as shown below:

Column 8, line 42, "strp" should be --strip--.

Column 9, line 32, after "balance" insert --assembly--.

Signed and Sealed this

*Twenty-ninth* Day of *January 1980*

[SEAL]

*Attest:*

SIDNEY A. DIAMOND

*Attesting Officer*

*Commissioner of Patents and Trademarks*